US009705215B2

(12) United States Patent
Ozaki

(10) Patent No.: US 9,705,215 B2
(45) Date of Patent: Jul. 11, 2017

(54) ELECTRICAL CONNECTOR HAVING TWO MOVABLE PARTS

(71) Applicant: TOYOTA JIDOSHA KABUSHIKI KAISHA, Toyota-shi, Aichi-ken (JP)

(72) Inventor: Hitoshi Ozaki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/228,798

(22) Filed: Aug. 4, 2016

(65) Prior Publication Data

US 2017/0093060 A1 Mar. 30, 2017

(30) Foreign Application Priority Data

Sep. 30, 2015 (JP) ..... 2015-194816

(51) Int. Cl.

| | |
|---|---|
| ***H01R 13/70*** | (2006.01) |
| ***H01R 12/70*** | (2011.01) |
| ***H01R 12/82*** | (2011.01) |
| ***H01R 13/50*** | (2006.01) |
| ***H01R 13/518*** | (2006.01) |

(52) U.S. Cl.

CPC ..... *H01R 12/707* (2013.01); *H01R 12/82* (2013.01); *H01R 13/50* (2013.01); *H01R 13/518* (2013.01)

(58) Field of Classification Search

CPC ..... H01R 12/89; H01R 12/91; H01R 13/6315
USPC ..... 439/263, 374, 247, 248
See application file for complete search history.

(56) References Cited

U.S. PATENT DOCUMENTS

| | | | | |
|---|---|---|---|---|
| 8,845,349 | B2 * | 9/2014 | Shindo | H01R 13/533 439/247 |
| 9,166,333 | B2 * | 10/2015 | Shindo | H01R 13/629 |
| 9,172,172 | B2 * | 10/2015 | Shindo | H01R 13/46 |
| 9,190,770 | B2 * | 11/2015 | Shindo | H01R 13/62 |
| 9,444,185 | B2 * | 9/2016 | Noguchi | H01R 13/631 |
| 2014/0011383 | A1 * | 1/2014 | Uchida | H01R 13/5219 439/271 |
| 2014/0273603 | A1 | 9/2014 | Shindo et al. | |
| 2015/0111419 | A1 | 4/2015 | Komiyama et al. | |

FOREIGN PATENT DOCUMENTS

| | | | |
|---|---|---|---|
| JP | 2010-146873 | A | 7/2010 |
| JP | 2014-010949 | A | 1/2014 |
| JP | 2014-154452 | A | 8/2014 |

* cited by examiner

*Primary Examiner* — Tulsidas C Patel
*Assistant Examiner* — Marcus Harcum
(74) *Attorney, Agent, or Firm* — Oliff PLC

(57) ABSTRACT

A housing of a lower connector has an opening on a side of an upper connector, and houses two movable parts movably from a first state of, by having upper portions thereof engaged with the opening, being in proximity to each other to form a guide hole, and a second state of, by releasing the engagement, being distanced from an external signal terminal. At positions contactable with the two movable parts, the housing has a protrusion whose tip gradually tapers toward the two movable parts in directions in which the two movable parts face each other. The protrusion guides the two movable parts in mutually separating directions, when the engagement between the opening of the housing and the upper portions of the two movable parts is released associated with depression of the upper connector, and the tip enters the gap through which the two movable parts face each other.

1 Claim, 13 Drawing Sheets

ELECTRICAL CONNECTOR HAVING TWO MOVABLE PARTS

BACKGROUND OF THE INVENTION

Field of the Invention

The present invention relates to a connector including an upper connector and a lower connector respectively disposed on top and bottom of a circuit board, and the connector is configured to connect an external signal terminal inserted from the lower connector side to the circuit board via a connection terminal of the upper connector.

Description of the Background Art

For example, Patent Literature 1 (Japanese Laid-Open Patent Publication No. 2014-154452) discloses a connector including a lower connector disposed on the lower surface of a circuit board, and an upper connector disposed on the upper surface of the circuit board and configured to connect an external signal terminal inserted from the lower connector side to the circuit board via a connection terminal. In this hitherto known connector, two movable parts are included in the lower connector, and, when the two movable parts are moved in proximity while facing each other, a guide hole for guiding the signal terminal inserted from the outside to the connection terminal of the upper connector is formed. The guide hole is also disclosed in, for example, Patent Literature 2 (Japanese Laid-Open Patent Publication No. 2010-146873).

In this hitherto known connector, after the signal terminal is inserted, the two movable parts in proximity to each other are separated from each other and distanced from the signal terminal to create a certain distance between the signal terminal and the two movable parts. For the transition of the two movable parts from the proximate state to the separated stated, a pin disposed on the upper connector for depressing the two movable parts, and an urging member configured to provide a bias force to the two movable parts in directions separating the two movable parts from each other are used.

With the transition of states described above, the possibility of the signal terminal making contact with the two movable parts to cause bending of the signal terminal or breakage of the connector is reduced, even when the connector is used in an environment with much vibration such as in a vehicle.

With the connector having the above described structure, the signal terminal may be in some cases inserted in the guide hole of the lower connector in a tilted manner. In such cases, frictional force is generated as a result of the tilted signal terminal being pressed against the guide hole (two movable parts).

Thus, with the connector disclosed in Patent Literature 1 described above, when the frictional force generated as a result of the signal terminal being pressed against the guide hole exceeds the bias force of the urging member, the two movable parts may not transition from the proximate state to the separated state even when the two movable parts are depressed by the pin disposed on the upper connector.

SUMMARY OF THE INVENTION

The present invention has been made in view of the above described problem, and an objective of the present invention is to provide a connector that reduces the possibility of the two movable parts not separating from each other and making contact with the signal terminal.

In order to solve the above described problem, a first invention according to the present disclosure is a connector including a lower connector disposed on a lower surface of a circuit board, and upper connector disposed on an upper surface of the circuit board and configured to connect an external signal terminal inserted from the lower connector side to the circuit board via a connection terminal. The lower connector includes: two movable parts configured to form a guide hole for guiding the external signal terminal to the connection terminal of the upper connector when the two movable parts are moved in proximity while facing each other; a housing having an opening on a side of the upper connector, and configured to house the two movable parts movably from a first state in which the guide hole is formed when an engagement between the opening and upper portions of the two movable parts is formed to a second state in which the engagement is released and the two movable parts are distanced from the external signal terminal; and an urging member configured to provide a bias force to the two movable parts in directions separating the two movable parts from each other. The upper connector includes a depress part for depressing the two movable parts housed in the housing. The housing includes a protrusion which is disposed at a position enabling the housing to make contact with the two movable parts and is provided with, in a direction in which the two movable parts face each other at a tip of the protrusion, a taper that gradually tapers toward the two movable parts. The protrusion is configured to, after the engagement between the opening of the housing and the upper portions of the two movable parts is released associated with depressing by the depress part, cause the tip of the protrusion to enter a gap through which the two movable parts face each other, and guide the two movable parts in directions separating the two movable parts from each other.

In the connector according to the first invention, a protrusion is disposed at a position enabling the housing of the lower connector to make contact with the two movable parts. At the tip of the protrusion, a taper that gradually tapers toward the two movable parts is formed in a direction in which the two movable parts face each other. When engagement between the housing and the two movable parts is released, the tip of the protrusion enters the gap through which the two movable parts face each other, and guides the two movable parts in directions separating the two movable parts from each other. This movement in the separation directions effectively acts upon the bias force provided to the two movable parts by the urging member. As a result, the two movable parts easily separate from each other.

In a second invention according to the present disclosure based on the first invention, the two movable parts include a groove part which is disposed at a position, in the first state, enabling engagement with the protrusion and which has, in a direction in which the two movable parts face each other and at an end point where a contact is made with the tip of the protrusion, a taper gradually expanding toward the protrusion. The protrusion is configured to, after the engagement between the opening of the housing and the upper portions of the two movable parts is released associated with depressing by the depress part, cause the tip to enter, via the groove part, the gap through which the two movable parts face each other, and guide the two movable parts in the directions separating the two movable parts from each other.

In the connector of the second invention, a groove part corresponding to the protrusion is formed on the two movable parts of the lower connector. As a result, the tip of the protrusion can easily enter the gap between two movable parts when the tip is simply butted against the end point of the groove part.

With the connector of the present invention, the possibility of the two movable parts not separating from each other but making contact with the signal terminal can be reduced.

These and other objects, features, aspects and advantages of the present invention will become more apparent from the following detailed description of the present invention when taken in conjunction with the accompanying drawings.

DESCRIPTION OF THE PREFERRED EMBODIMENTS

[General Outline]

Figure 1:
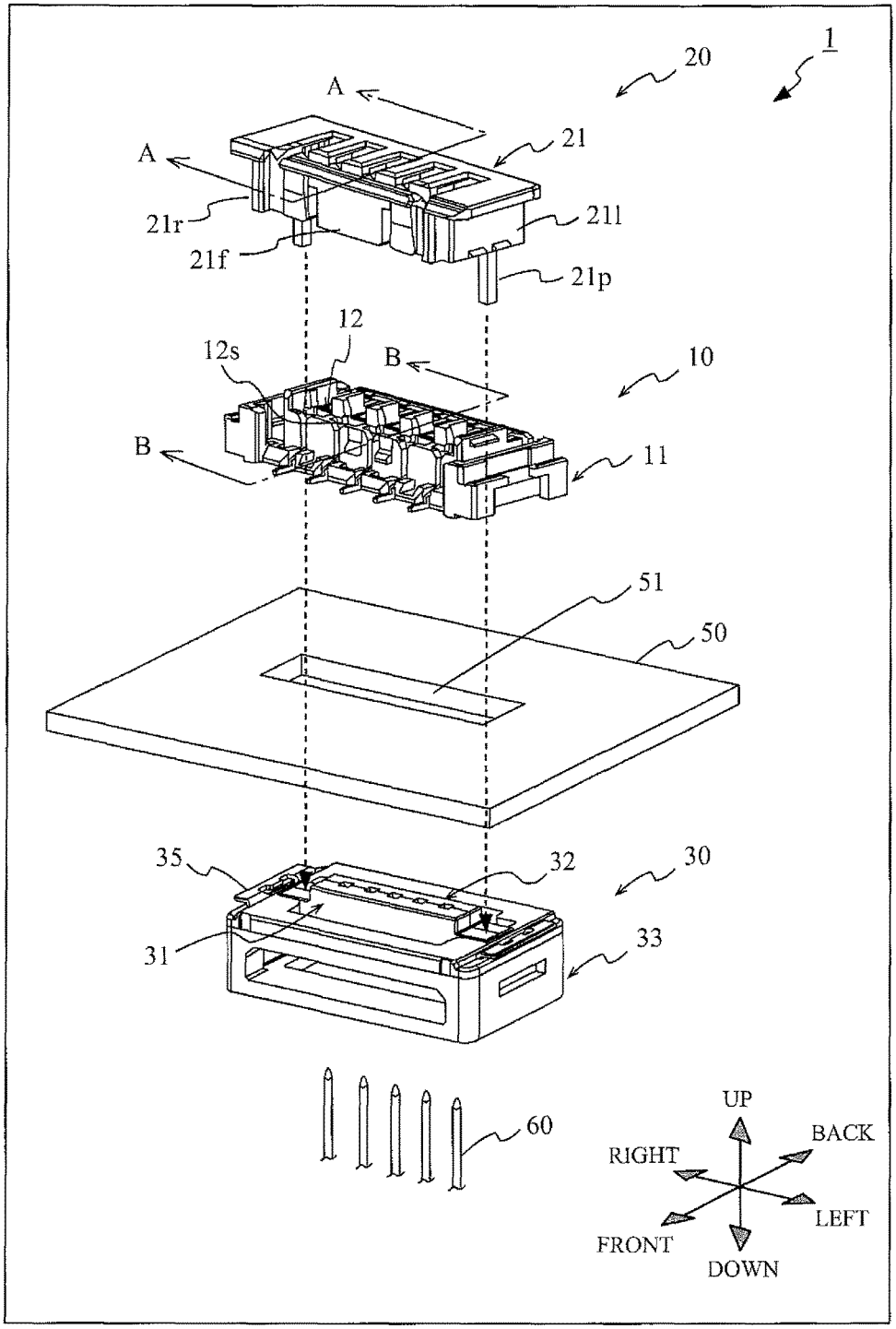
FIG. 1 is an exploded perspective view explaining the structure of a connector according to one embodiment of the present invention.

A connector of the present invention is a connector including an upper connector and a lower connector. In the connector, the lower connector includes two movable parts that can take a first state in which the two movable parts are moved in proximity to each other to form a guide hole into which external signal terminals are inserted, and a second state in which the two movable parts are separated from each other to be disengaged from the external signal terminals. In the present connector, a protrusion having a predetermined shape is disposed at a position where contact can be made with the two movable parts of the lower connector, and guides the two movable parts in directions separating the two movable parts from each other during transition from the first state to the second state. Thus, the two movable parts can be easily separated from each other because of a synergistic effect between the guidance in the separation directions and a bias force provided by an urging member in the separation directions. Thus, the possibility of the two movable parts not separating from each other but making contact with the signal terminal can be reduced.

In the following, embodiments of the invention will be described in detail with reference to the drawings. Respective directions of front, back, right, left, up, and down will be defined in advance as shown in the drawings, and the embodiments will be described in accordance with this definition.

[Overall Structure of Connector]

As shown in FIG. 1 and FIG. 2A through FIG. 2D, a connector 1 according to one embodiment of the present invention includes a lower connector 30 and an upper connector including a first connector 10 and a second connector 20. The first connector 10 and the second connector 20 are disposed on the upper surface side of a circuit board 50, and the lower connector 30 is disposed on the lower surface side of the circuit board 50.

The first connector 10 is attached to a predetermined position on the upper surface of the circuit board 50. The second connector 20 is built in the first connector 10 in a state of being slidable in the up-down direction, which is perpendicular with respect to the circuit board 50. The lower connector 30 is attached at a predetermined position on the lower surface of the circuit board 50 in a state in which portions (upper stages of the movable parts described later) protruding on the upper surface are inserted in a substantially rectangular penetration hole 51 formed on the circuit board 50. External signal terminals 60 which are to be electrically connected to the connector 1 are inserted from the lower surface of the lower connector 30 and are connected to female terminals 12 of the first connector 10 described later through the lower connector 30 and the circuit board 50 (FIG. 2D).

[Components Forming the Connector]

First, the first connector 10, the second connector 20, and the lower connector 30 forming the connector 1 will be described.

1. First Connector

Figure 2A:
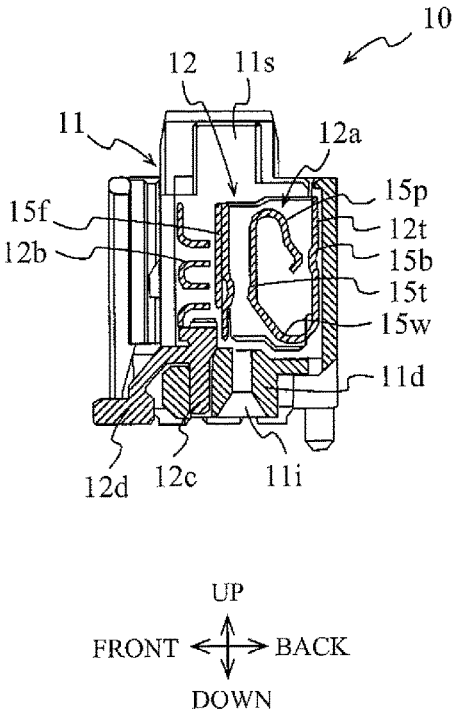
FIG. 2A is a cross sectional view of a second connector (cross sectional view along line A-A in FIG. 1)

As shown in FIG. 1 and FIG. 2A, the first connector 10 includes a housing 11 and five of the female terminals 12.

1-1. Housing

The housing 11 is a substantially rectangular parallelepiped-shaped component formed from, for example, a resin material having insulation property. On the housing 11, five housing compartments 11*s* capable of housing the respective five female terminals 12 are formed side by side in the right-left direction. The upper ends of the housing compartments 11*s* are open, and depress pins 21*p* and pressure-contact pins 22 (described later) of the second connector 20 can be inserted in the housing compartments 11*s* from the openings (see FIG. 2B).

At a bottom part 11*d* of the housing 11, insertion holes 11*i* through which the external signal terminals 60 that have penetrated the circuit board 50 are inserted are formed. The insertion holes 11*i* have a hole diameter that is larger than the outer circumference diameter of the external signal terminals 60, and are provided with a forward tapered shape whose opening size becomes smaller in a direction in which the external signal terminals 60 are inserted. With such a configuration, the external signal terminals 60 can be easily inserted from below into the housing compartments 11*s* beyond the insertion holes 11*i*.

1-2. Female Terminal

The female terminals 12 are terminals for electrical connection, each formed from, for example, a metallic member having conductive property. The female terminals 12 each have a square tube part 12*t* whose upper end and lower end are open, a bent part 12*a* that is bent and almost forms a complete loop inside the square tube part 12*t*, an elastic part 12*b* that elastically moves in the up-down direction, etc., a fixed part 12*c* disposed outside the housing compartments 11*s*, and a circuit board connection part 12*d*. The fixed part 12*c* is extended downward from a lower end of the elastic part 12*b*, and is fixed on the bottom part 11*d* of the housing 11. In addition, the circuit board connection part 12*d* extends diagonally downward from part way through the fixed part 12*c*, and is electrically connected to a predetermined portion of the circuit board 50 with soldering (see FIG. 2D).

The square tube part 12*t* has a front wall part 15*f* and a back wall part 15*b* facing each other in the front-back direction. On each of the front wall part 15*f* and the back wall part 15*b*, a protrusion part protruding in a direction facing the other is formed. The bent part 12*a* has a lower bent part 15*w* that is bent downward from the back wall part 15*b* in a convex shape, a straight part 15*t* extending upward from the lower bent part 15*w*, and a protruding part 15*p* that protrudes from the straight part 15*t* toward the front wall part 15*f* in a convex shape. Each of the pressure-contact pins 22 of the second connector 20 is inserted between the protrusion part of the back wall part 15*b* and the protruding part 15*p*, and each of the external signal terminals 60 is inserted between the protrusion part of the front wall part 15*f* and the straight part 15*t*.

2. Second Connector

Figure 2B:
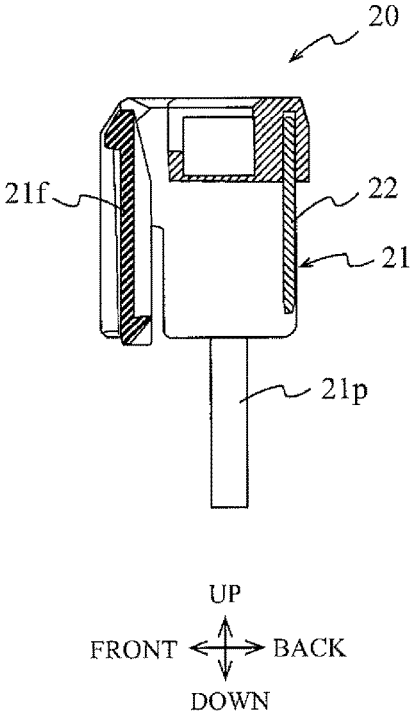
FIG. 2B is a cross sectional view of a first connector (cross sectional view along line B-B in FIG. 1)
Figure 2C:
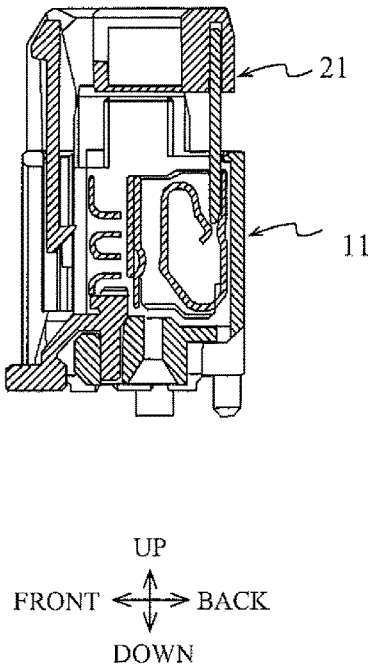
FIG. 2C is a cross sectional view of a state in which the first connector and the second connector are engaged.
Figure 2D:
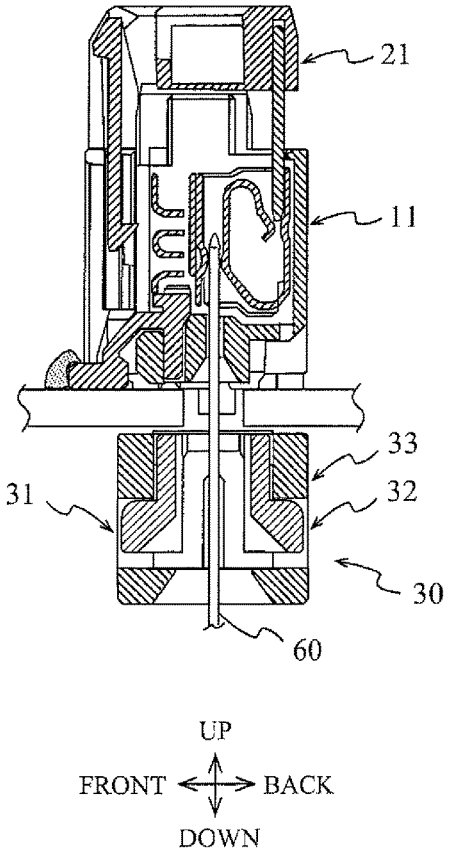
FIG. 2D is a cross sectional view of a state in which the first connector, the second connector, a circuit board, a lower connector, and external signal terminals are engaged.

The second connector 20 includes a substantially box-like housing 21 formed from, for example, a resin material having insulation property shown in FIG. 1 and FIG. 2B. The housing 21 has four lateral walls 21*f*, 21*b*, 21*r*, and 211, and forms a space capable of housing the first connector 10 inside the four lateral walls.

To the housing 21, the pressure-contact pins 22 having a long shape extending in the up-down direction are mounted. The pressure-contact pins 22 are inserted inside the first connector 10. On the lateral walls 21*r* and 211 on the right and left, the depress pins 21*p* protruding downward from the lower end toward the circuit board 50 are disposed. In a installed state of the connector 1 in which the first connector 10, the second connector 20, and the lower connector 30 are attached to the circuit board 50 (see FIG. 2D); the depress pins 21*p* are formed at positions and with a size enabling depressing of upper surfaces of a first movable part 31 and a second movable part 32 of the lower connector 30 described later when the second connector 20 is slid downward with respect to the circuit board (see dotted line arrows in FIG. 1).

3. Lower Connector

As shown in FIGS. 3 to 6, the lower connector 30 includes the first and second movable parts 31 and 32 disposed so as to face each other in the front-back direction, a housing 33 configured to house the movable parts, urging members 34 disposed between the movable parts, and reinforcement tabs 35. The lower connector 30 can take the "first state" (FIG. 4A) in which the first and second movable parts 31 and 32 are in proximity with each other, and the "second state" (FIG. 4B) in which the first and second movable parts 31 and 32 are separated from each other.

3-1. Movable Part

Figure 3:
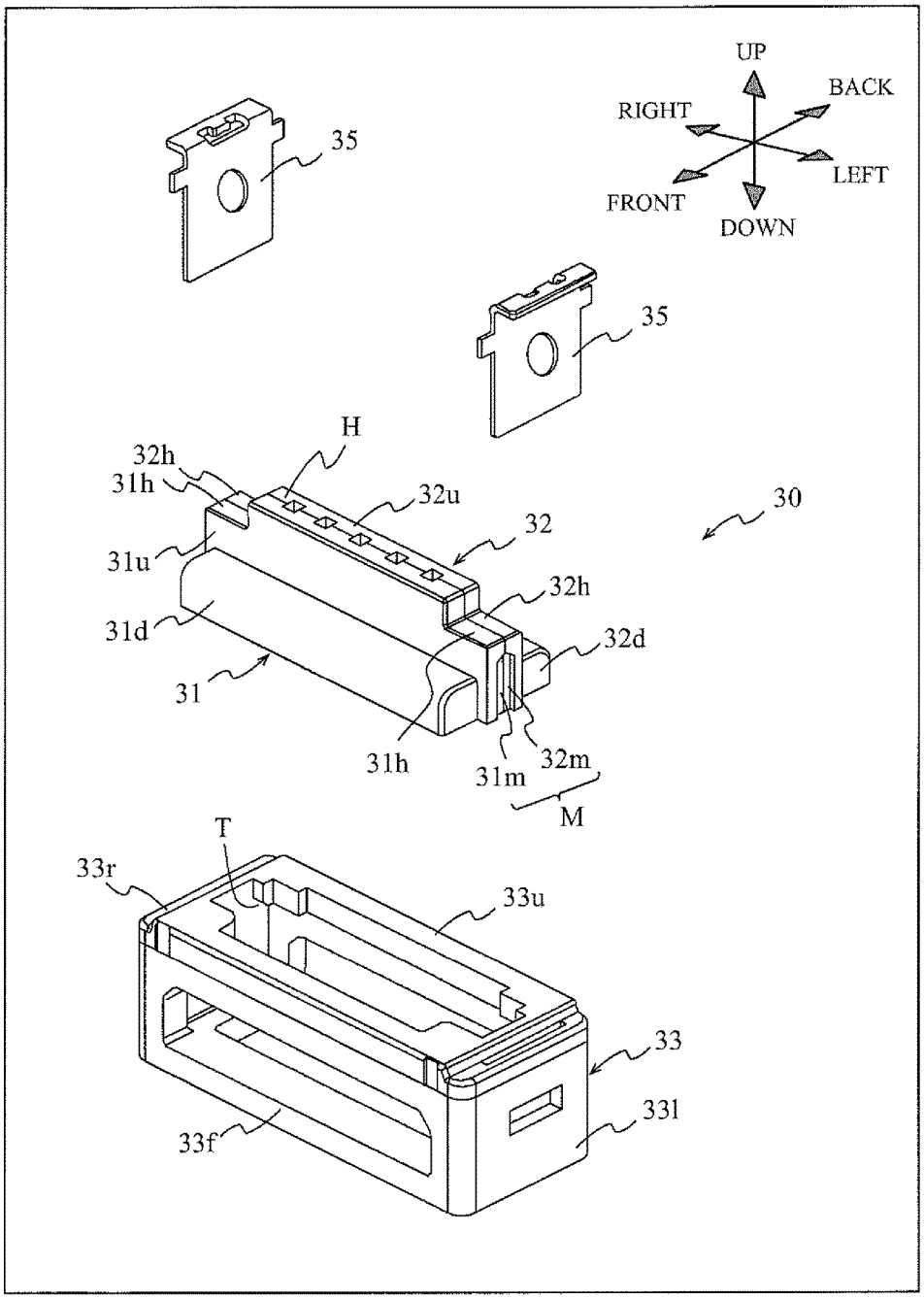
FIG. 3 is an exploded perspective view for explaining the structure of the lower connector.
Figure 4A:
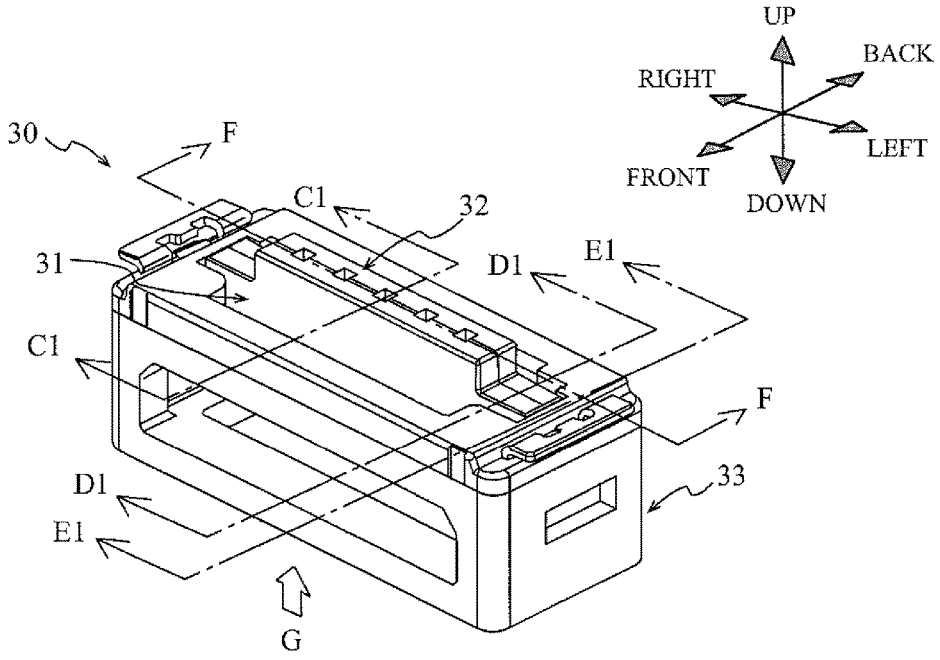
FIG. 4A is a diagrammatic perspective view of the lower connector in a state in which movable parts are in proximity of each other.
Figure 4B:
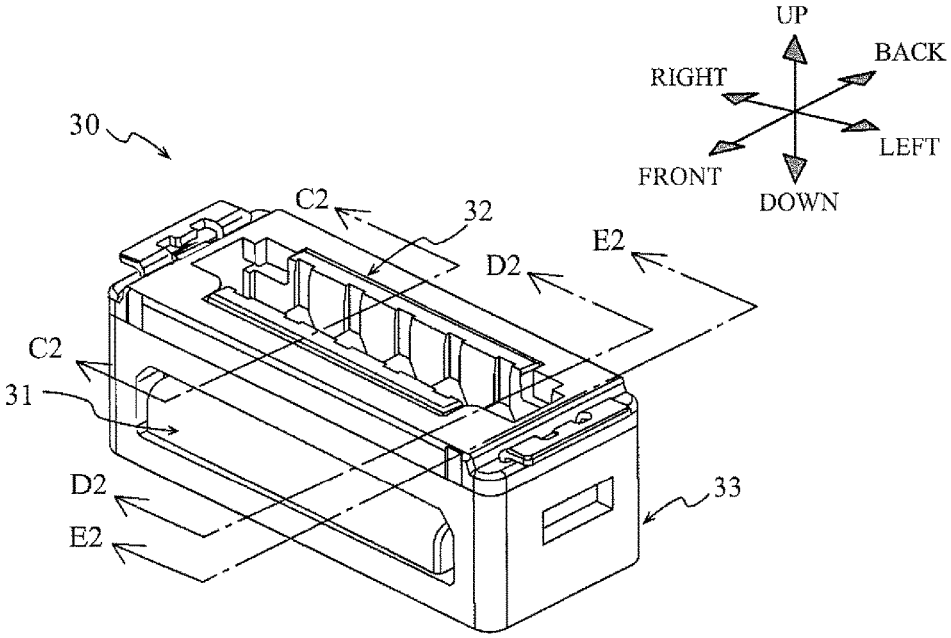
FIG. 4B is a diagrammatic perspective view of the lower connector in a state in which the movable parts are separated from each other.

The first and second movable parts 31 and 32 have substantially the same shape in which a long direction thereof is the right-left direction, and are disposed so as to be symmetric in the front-back direction by having long lateral surfaces (opposing surfaces) of each of the movable parts fitted together, as shown in FIG. 3. The first and second movable parts 31 and 32 are each formed from, for example, a resin material having insulation property.

In the first movable part 31, a long lateral surface (open surface) opposite of the opposing surface has a staircase shape having an upper stage 31*u* and a lower stage 31*d*. Similarly, in the second movable part 32, a long lateral surface (open surface) opposite of the opposing surface has a staircase shape having an opposite upper stage 32*u* and a lower stage 32*d*. At the ends of the upper stage 31*u* of the first movable part 31 and the upper stage 32*u* of the second movable part 32 in the right-left direction, pin-receiving surfaces 31*h* and 32*h* whose heights are lower than the upper surface of central parts are respectively formed. The pin-receiving surfaces 31*h* and 32*h* are positions where the depress pins 21*p* of the second connector 20 make contact.

Figure 5A:
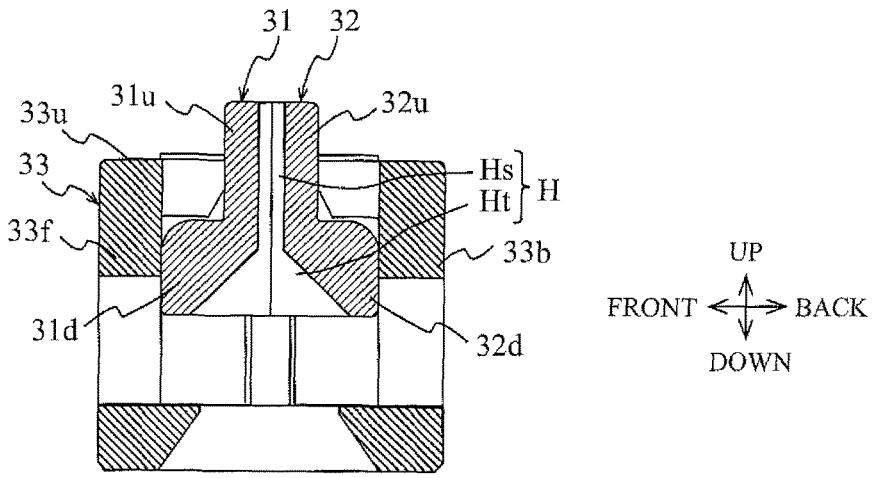
FIG. 5A is a cross sectional view of the lower connector (cross sectional view along line C1-C1 in FIG. 4A)
Figure 6A:
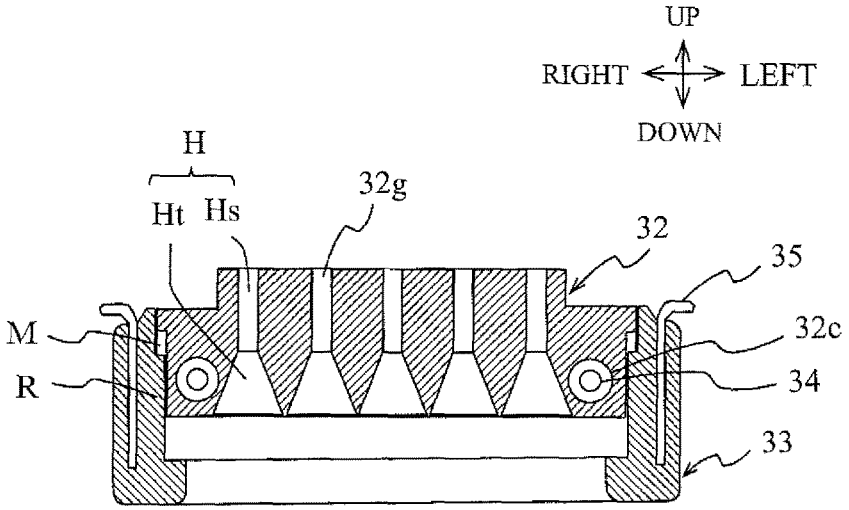
FIG. 6A is a cross sectional view of the lower connector (cross sectional view along line F-F in FIG. 4A)
Figure 6B:
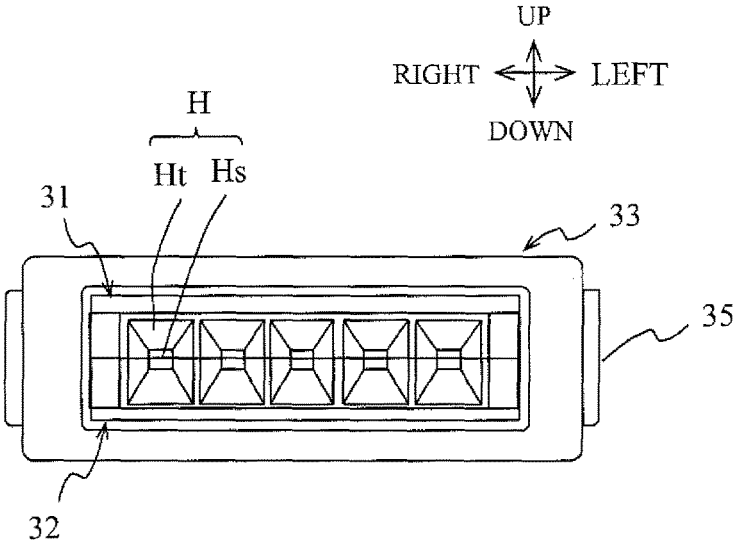
FIG. 6B is a bottom view of the lower connector (arrow view as seen from direction G in FIG. 4A)

On opposing surfaces of the first and second movable parts 31 and 32, guide grooves 31*g* and 32*g* are respectively formed in the right-left direction at equal intervals. In the first state in which the opposing surfaces of the first and second movable parts 31 and 32 are fitted together, the guide grooves 31*g* and 32*g* form pierced guide holes H. The guide holes H are holes for guiding the external signal terminals 60 inserted from the lower side of the lower connector 30 to the insertion holes 11*i* of the first connector 10. As shown in FIG. 5A, FIG. 6A, and FIG. 6B, each of the guide holes H is formed of a straight part Hs whose horizontal cross section is substantially rectangular, and an opening part Ht having a substantially pyramid-like shape having a slope expanding downward form the lower end of the straight part Hs. In the present embodiment, five of the guide holes H are formed in accordance with the number of the external signal terminals 60.

On the opposing surfaces of the first and second movable parts 31 and 32, concaved parts 31*c* and 32*c* for housing the urging members 34 are respectively formed on the right-and-left end sides of the lower stage 31*d* and the lower stage 32*d*. When one ends of the urging members 34 are housed in the concaved parts 31*c* of the first movable part 31 and the other ends of the urging members 34 are housed in the concaved parts 32*c* of the second movable part 32, the first and second movable parts 31 and 32 are given a bias force that separates the first and second movable parts 31 and 32 from each other in the front-back direction.

On short lateral surfaces of the first and second movable parts 31 and 32, concaved parts 31*m* and 32*m* having a certain depth are respectively formed. The concaved parts 31*m* and 32*m* are formed by forming notches on the opposing surface sides and the lower surface sides, and forming groove parts M whose upper sides are closed and lower side are open in the first state in which the opposing surfaces of the first and second movable parts 31 and 32 are fit together. At an end point on the closed side of each of the groove parts M, a taper whose groove width gradually expands from the upper side toward the lower side (toward a protrusions R) is formed in the direction in which the first and second movable parts 31 and 32 face each other (front-back direction) (see FIG. 3). The groove parts M can engage the protrusions R disposed on inner surfaces of lateral walls 33*r* and 33*l* of the housing 33 described later. The groove parts M can be omitted when the groove parts M are not intended to engage the protrusions R.

3-2. Housing

The housing 33 is a substantially box-shaped component formed of an upper part 33*u*, a bottom part 33*d*, and four lateral walls 33*f*, 33*b*, 33*r*, and 33*l*. Inside the housing 33, space that can house the first and second movable parts 31 and 32 is formed. The housing 33 is formed from, for example, a resin material having insulation property.

On the upper part 33*u*, an opening that engages and houses, in the first state, the upper stage 31*u* of the first movable part 31 and the upper stage 32*u* of the second movable part 32 in a state of being protruded from the upper surface of the housing 33 is formed. Thus, when upper portions of the first and second movable parts 31 and 32 engage the upper opening of the housing 33, the first and second movable parts 31 and 32 are brought in proximity to each other and the guide holes H are formed. A chamfer part T is disposed inside the upper part 33*u* (FIG. 3 and FIG. 5E). As described later, the chamfer part T is provided for easily guiding the first and second movable parts 31 and 32 in directions separating the movable parts from each other. On the lateral walls 33*f* and 33*b* at the front and back, openings that engage and house, in the second state, the lower stage 31*d* of the first movable part 31 and the lower stage 32*d* of the second movable part 32 are formed. On the bottom part 33*d*, an opening through which the external signal terminals 60 are inserted from the lower side is formed. On the lateral walls 33*r* and 331 on the right and left, holes that engage the reinforcement tabs 35 are formed.

Figure 5B:
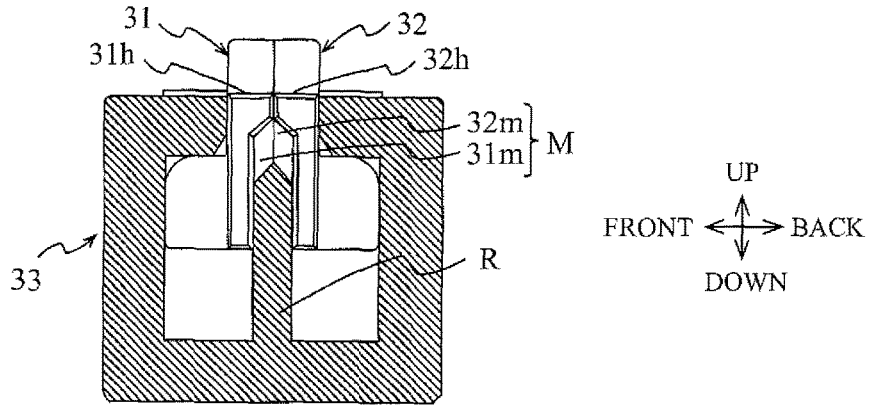
FIG. 5B is a cross sectional view of the lower connector (cross sectional view along line D1-D1 in FIG. 4A)
Figure 5C:
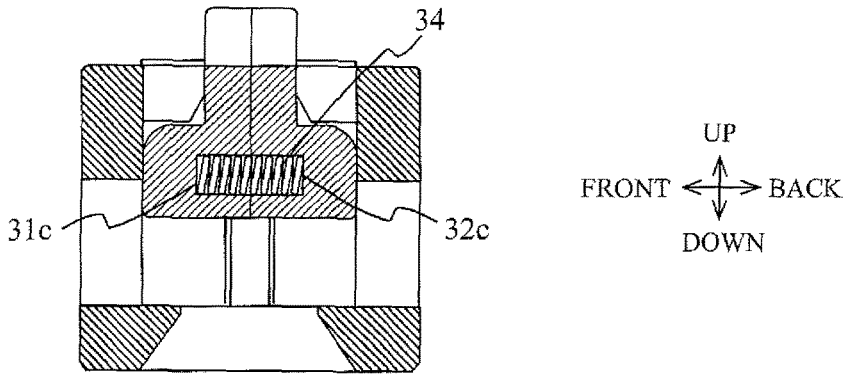
FIG. 5C is a cross sectional view of the lower connector (cross sectional view along line E1-E1 in FIG. 4A)
Figure 5D:
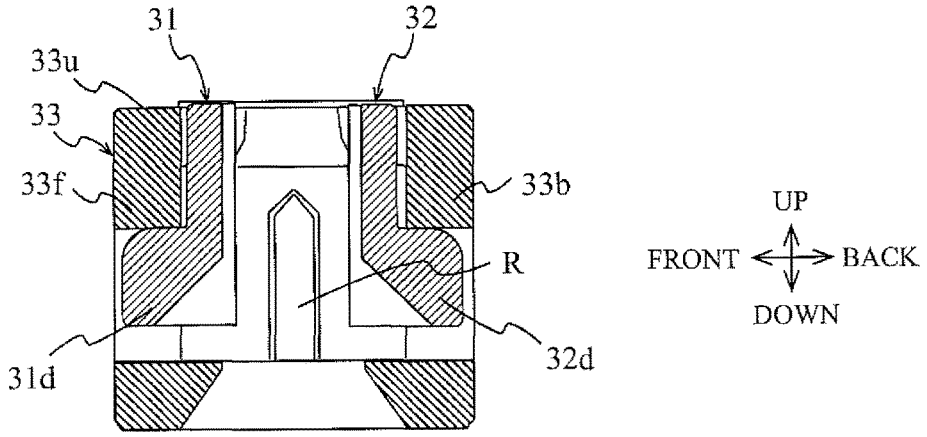
FIG. 5D is a cross sectional view of the lower connector (cross sectional view along line C2-C2 in FIG. 4B)
Figure 5E:
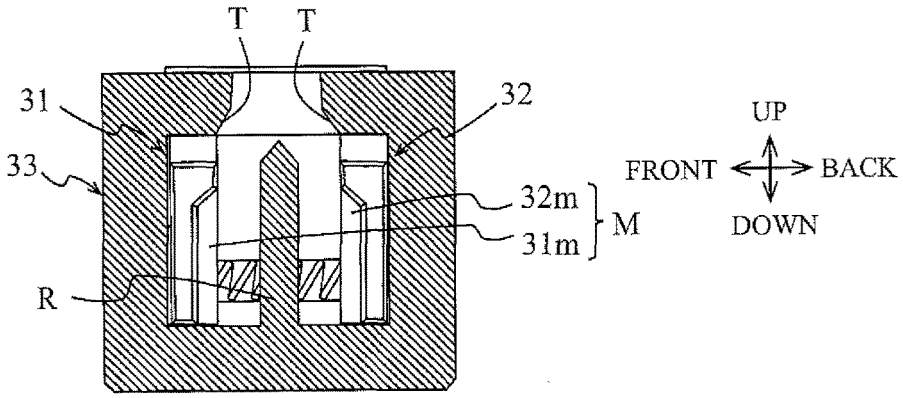
FIG. 5E is a cross sectional view of the lower connector (cross sectional view along line D2-D2 in FIG. 4B)
Figure 5F:
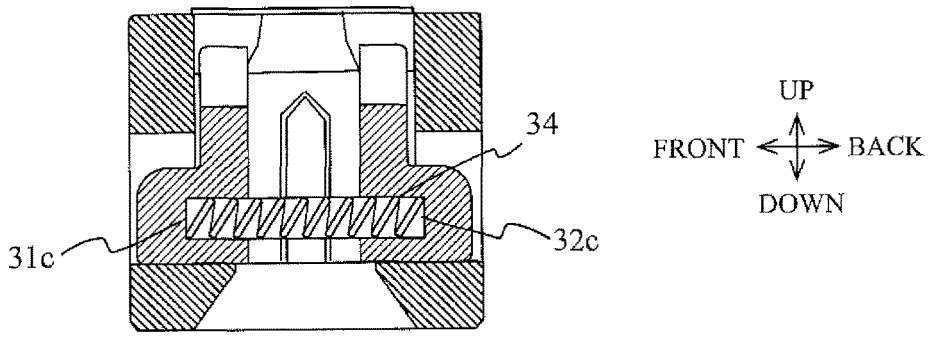
FIG. 5F is a cross sectional view of the lower connector (cross sectional view along line E2-E2 in FIG. 4B)

On the inner surfaces of the lateral walls 33*r* and 33*l* at the right and left, the respective protrusions R having a certain height and protruding inward of the housing 33 are formed as shown in FIG. 5B and FIG. 5E. The protrusions R are disposed at positions where contacts with the first and second movable parts 31 and 32 are possible. Each of the protrusions R has a tip that enters, when making contact with the first and second movable parts 31 and 32, the gap between the first and second movable parts 31 and 32. Each of the protrusions R has a substantially rectangular shape extending, for example, upward from the bottom part 33*d* at center positions of the lateral walls 33*r* and 33*l*, and the tip of each of the protrusions R has a taper that gradually tapers toward the upper part 33*u* (toward the first and second movable parts 31 and 32) in a direction in which the first and second movable parts 31 and 32 face each other (front-back direction).

By having the tip having the taper enter the gap between the first and second movable parts 31 and 32, the protrusions R guide the transfer of the first and second movable parts 31 and 32 from the first state to the second state as a result of an action described later. Alternatively, by having the protrusions R engage the groove parts M formed on short lateral surfaces of the first and second movable parts 31 and 32, the protrusions R can also guide the transfer of the first and second movable parts 31 and 32 from the first state to the second state.

When the protrusions R are to engage the groove parts M, the protrusions R may be shaped as described next. First, the width of each of the protrusions R is smaller than the width of each of the groove parts M. As a result, the protrusions R can engage the groove parts M and slide in the up-down direction. Furthermore, the angle of the taper provided on the tip of each of the protrusions R is smaller than the angle of the taper provided on an end point of each of the groove parts M. As a result, the tip of each of the protrusions R can easily enter the gap between the first and second movable parts 31 and 32. Still further, the length of the protrusions R is set to a length such that the tip of each of the protrusions R butts the end point of each of the groove parts M during the course of the transition of the first and second movable parts 31 and 32 from the first state to the second state. As a result, the first and second movable parts 31 and 32 can be easily separated from each other.

When the tip of each of the protrusions R is to enter the gap between the first and second movable parts 31 and 32 not having the groove parts M formed thereon, for example in the first state, the protrusions R can be formed such that the tips thereof are positioned below the lower surfaces of the first and second movable parts 31 and 32 (not diagrammatically represented).

3-3. Urging Member

Each of the urging members 34 is a member that elastically deforms in the front-back direction, and provides a bias force against the first and second movable parts 31 and 32 in directions separating the first and second movable parts 31 and 32 from each other. As the urging members 34, for example, helical springs can be used.

3-4. Reinforcement Tab

Each of the reinforcement tabs 35 is a substantially quadrangular plate-like member, and is formed from, for example, a metal material on which soldering can be provided. Upper ends of the reinforcement tabs 35 are bent approximately 90 degrees, and lower ends below the upper ends are fitted in respective holes of the lateral walls 33*r* and 33*l* of the housing 33. The lower connector 30 to which the reinforcement tabs 35 are engaged is mounted on the lower surface of the circuit board 50, and the upper ends of the reinforcement tabs 35 are soldered to the circuit board 50.

[External Signal Terminal Connection Method at Connector]

Figure 7A:
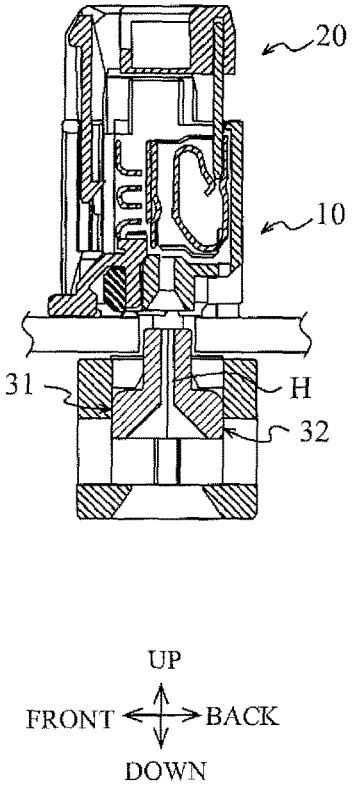
FIG. 7A and FIG. 7D are a cross sectional view of a connector in a half-engaged state in which the external signal terminals are not inserted.
Figure 7B:
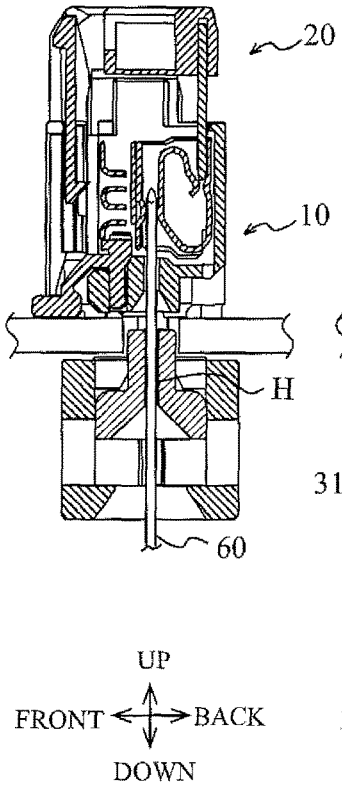
FIG. 7B and FIG. 7E are a cross sectional view of the connector in the half-engaged state in which the external signal terminals have been inserted.
Figure 7C:
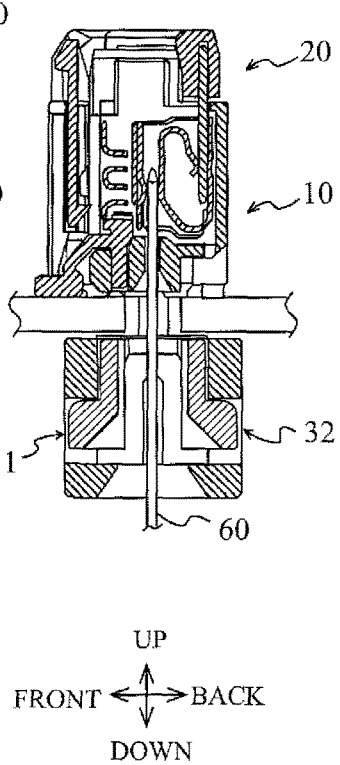
FIG. 7C and FIG. 7F are a cross sectional view of the connector in a fully engaged state.
Figure 7D:
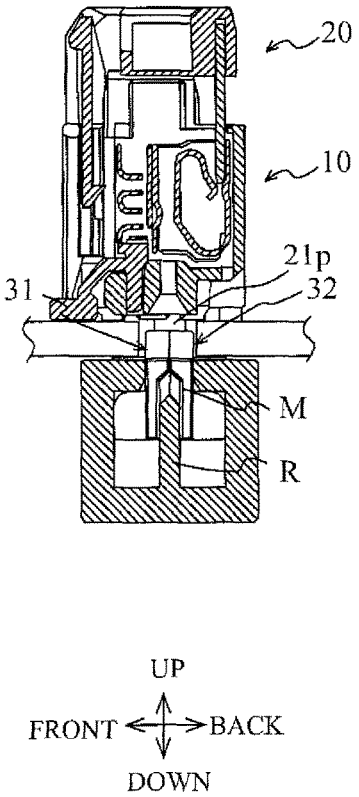
Figure 7E:
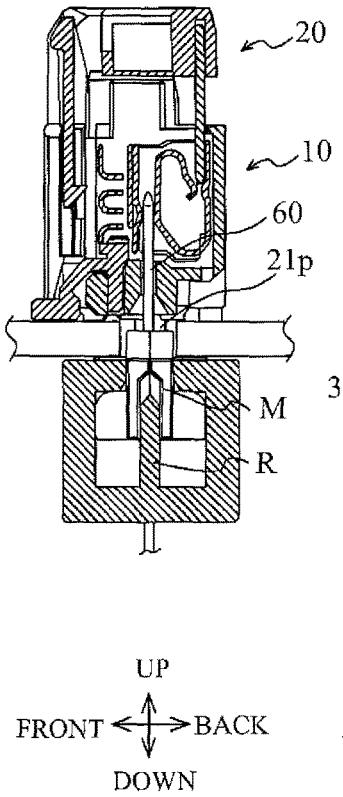
Figure 7F:
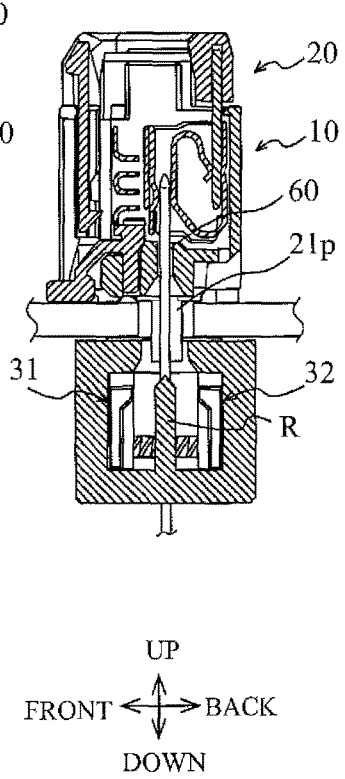

A method for connecting the external signal terminals 60 to the connector 1 according to one embodiment of the present invention will be described next with additional reference to FIGS. 7A through 7F and FIGS. 8A through 8E. FIGS. 7A through 7C show cross sectional views in the front-back direction showing the relationship between the guide holes H and the external signal terminals 60. FIGS. 7D through 7F show cross sectional views in the front-back direction showing the relationship between the protrusions R and the groove parts M.

FIG. 7A and FIG. 7D show cross sectional views of the connector 1 before the external signal terminals 60 are inserted therein. Before the external signal terminals 60 are inserted, the second connector 20 is in a "half-engaged state" of being part way inserted to the first connector 10. The half-engaged state is a state as shown in the diagram above in FIG. 7A in which the depress pins 21*p* are not in contact (or gently in contact) with the upper surfaces (the upper stage 31*u* and the upper stage 32*u*) of the first and second movable parts 31 and 32 of the lower connector 30. At this moment, the first and second movable parts 31 and 32 have the upper portions thereof (the upper stages 31*u* and 32*u*) engaged with the upper opening of the housing 33, and are in the first state of being in proximity to each other. The first state is fixed when the lateral surface of the lower stage 31*d* of the first movable part 31 makes contact with the lateral surface of the lateral wall 33*f* of the housing 33, and the lateral surface of the lower stage 32*d* of the second movable part 32 makes contact with the lateral surface of the lateral wall 33*b* of the housing 33 (see FIG. 5A).

FIG. 7B and FIG. 7E show cross sectional views of the connector 1 to which the external signal terminals 60 are inserted when the second connector 20 is in the half-engaged state as shown in FIG. 7A and FIG. 7D. In the half-engaged state, as shown in the diagram above in FIG. 7B, the inserted external signal terminals 60 are in proximity with the first and second movable parts 31 and 32 (more specifically, the guide grooves 31*g* and 32*g*). Also at this moment, the first and second movable parts 31 and 32 have the upper portions thereof engaged with the upper opening of the housing 33 and are in proximity with each other to maintain the first state.

FIG. 7C and FIG. 7F show cross sectional views of the connector 1 when the second connector 20 is in a "fully engaged state" when the external signal terminals 60 are inserted as shown in FIG. 7B and FIG. 7E. The fully engaged state is a state in which the second connector 20 is inserted in the first connector 10 until a contact is made. In the fully engaged state, the pin-receiving surfaces 31*h* and 32*h* of the first movable part 31 and the second movable part 32 are depressed by the depress pins 21*p*. As a result, the fixing of the housing 33 with respect to the first and second movable parts 31 and 32 in the first state described above is released. In other words, the engagement between the upper opening of the housing 33 and the upper portions of the first and second movable parts 31 and 32 is released, and the first and second movable parts 31 and 32 transition to the second state of being separated from each other and away from the external signal terminals 60 through an action of the bias force generated by the urging members 34 (above diagram of FIG. 7C). The second state is fixed when the lower stage 31*d* of the first movable part 31 fits into the opening of the lateral wall 33*f* of the housing 33, and the lower stage 32*d* of the second movable part 32 fits into the opening of the lateral wall 33*b* of the housing 33 (see FIG. 5D).

In the present embodiment the protrusions R are formed on the internal surface of both the lateral walls 33*r* and 33*l* located on the right and left of the housing 33. With this, when the first and second movable parts 31 and 32 transition from the first state to the second state, the first and second movable parts 31 and 32, on which the bias force generated by the urging members 34 is applied, are guided to directions separating the first and second movable parts 31 and 32 from each other. Particularly in the present embodiment, the groove parts M corresponding to the protrusions R are also formed on the short lateral surfaces of the first and second movable parts 31 and 32. With this, an action as described next is produced based on the shapes of, and the positional relationship between, the protrusions R and the groove parts M.

Figure 8A:
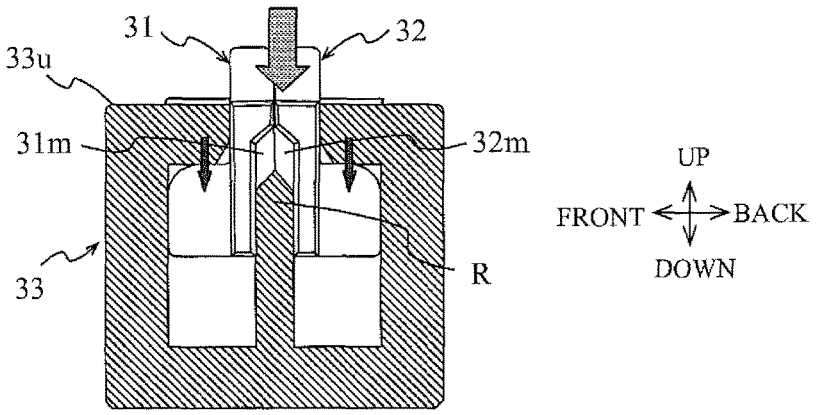
FIG. 8A is a cross sectional view of the lower connector in the half-engaged state.
Figure 8B:
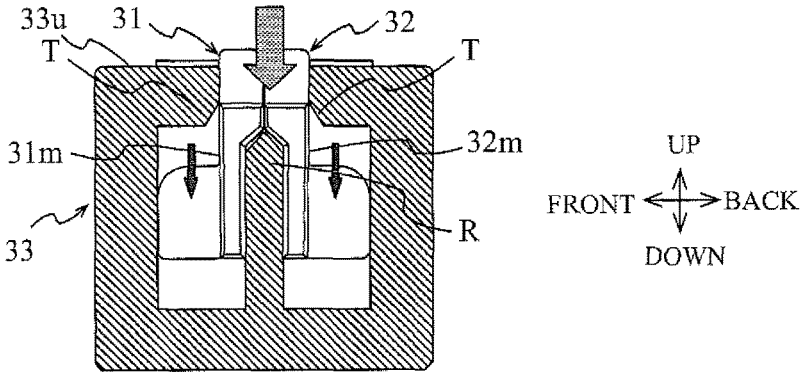
FIG. 8B, FIG. 8C, and FIG. 8D are a cross sectional view of the lower connector part way from the half-engaged state to the fully engaged state.
Figure 8C:
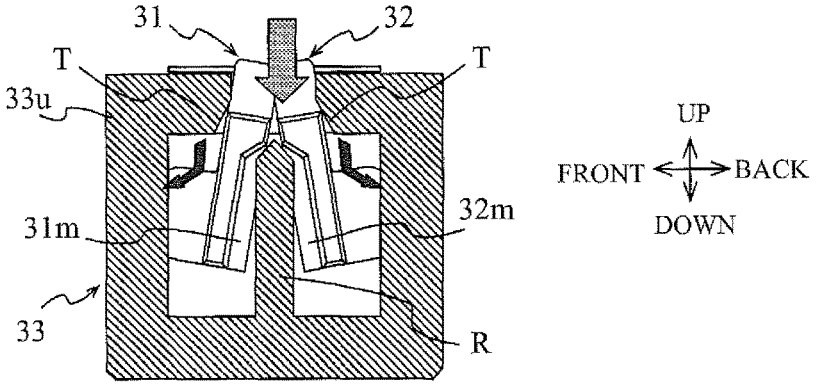
Figure 8D:
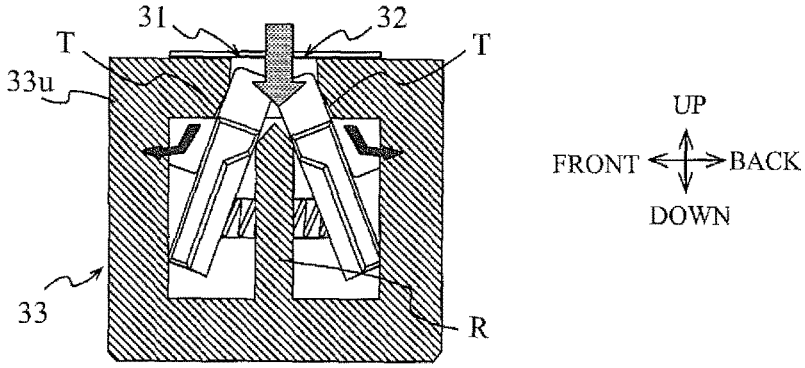
Figure 8E:
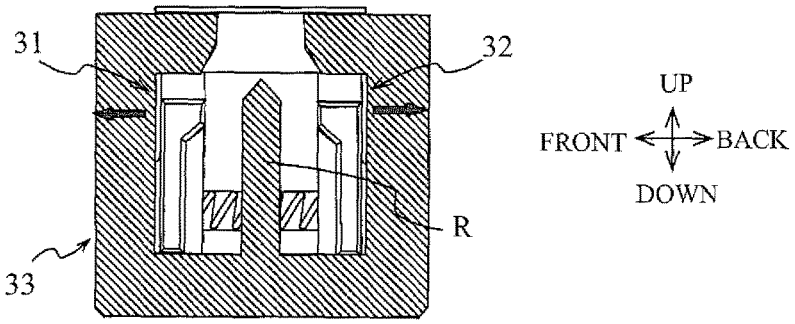
FIG. 8E is a cross sectional view of the lower connector in the fully engaged state.

When the first and second movable parts 31 and 32 are depressed downward by the depress pins 21*p* from the first state shown in FIG. 8A, engagement between the upper opening of the housing 33 and upper portions (the upper stages 31*u* and 32*u*) of the first and second movable parts 31 and 32 is released (FIG. 8B). Then, tips of the protrusions R of the housing 33 butt end points of the groove parts M of the first and second movable parts 31 and 32 (FIG. 8B). Even after the tips of the protrusions R butt the end points of the groove parts M, the depression of the first and second movable parts 31 and 32 downward by the depress pins 21*p* continues. As a result, the tapers provided on the tips of the protrusions R and the tapers provided on the end points of the groove parts M interact, and cause the tips of the protrusions R to enter the gap between the first and second movable parts 31 and 32 (FIG. 8C). The first and second movable parts 31 and 32 of which gap has been entered by the protrusions R are guided and pressed out in directions separating the first and second movable parts 31 and 32 from each other as a result of an interaction between the tapers provided on the tips of the protrusions R and the chamfer part T formed inside the upper part 33 of the housing 33 (FIG. 8D). The first and second movable parts 31 and 32, after being guided and pressed out in the separation directions, are subjected to the bias force by the urging members 34 and transition to the second state of being separated from each other (FIG. 8E).

As can be understood from the series of movement described above, after the engagement between the upper opening of the housing 33 and the upper portions of the first and second movable parts 31 and 32 is released associated with depressing by the depress pins 21*p*, the tips of the protrusions R enter the gap between the first and second movable parts 31 and 32. As a result the first and second movable parts 31 and 32 can be guided in directions causing separation. This guidance in the separation directions effectively acts on the bias force of the urging members 34, and causes easy separation of the first and second movable parts 31 and 32.

Functions and Effects of Embodiment

In the connector 1 of the present embodiment described above, the protrusions R are formed on the internal surfaces of the lateral walls 33*r* and 33*l* located on the right and left of the housing 33. When the engagement with the upper opening of the housing 33 is released and the first and second movable parts 31 and 32 move downward associated with depression of the second connector 20, the tips of the protrusions R enter the gap between the first and second movable parts 31 and 32 and the protrusions R guides the first and second movable parts 31 and 32 in directions separating each other. The movement in the separation directions effectively acts on the bias force provided to the first and second movable parts 31 and 32 by the urging members 34.

In particular, by forming the groove parts M corresponding to the protrusions R on the short lateral surfaces of the second movable part 32 and the first movable part 31 of the lower connector 30, the tips can easily enter the gap between the first and second movable parts 31 and 32 by simply butting the tips of the protrusions R against the end points of the groove parts M.

Thus, in the connector 1 of the present embodiment, the first and second movable parts 31 and 32 can easily separate from each other when compared to a conventional connector only using the bias force of the urging members 34. As a result, it is possible to reduce the possibility of occurrence of a state in which the first and second movable parts 31 and 32 do not transition to the second state after the external signal terminals 60 are inserted at the first state, resulting in the first and second movable parts 31 and 32 still being in proximity to the external signal terminals 60. With this, it is possible to prevent vibration friction caused between the external signal terminals 60 and the first and second movable parts 31 and 32, and reduce occurrence of instances such as bending of the external signal terminals 60 and damage to the lower connector 30.

Furthermore, in the connector 1 of the present embodiment, the protrusions R are formed such that, when the second connector 20 is incorporated until making contact with the first connector 10, the tips are formed in a shape for entering the gap between the first and second movable parts 31 and 32. Since guidance in the separation directions always occurs when the tips of the protrusions R enter the gap, the first and second movable parts 31 and 32 are structured so as to easily transition from the first state to the second state.

With this, it is also possible to determine in a simplified manner whether or not the first and second movable parts 31 and 32 are in the second state, by simply determining the state of incorporation of the first connector 10 and the second connector 20. For example, when the upper surface of the second connector 20 is protruding from the upper surface of the first connector 10, the first and second movable parts 31 and 32 can be determined not to be in the second state even without looking at the lower surface side of the circuit board 50.

[Modification]

In the connector 1 of the embodiment described above, the protrusions R are formed on the housing 33 of the lower connector 30. However, in this modification regarding a connector 2, the protrusions R are formed on the housing 21 of the second connector 20. In the following, other configurations and shape of the connector 2 according to the modification not described are identical to the configurations and shape of the connector 1 according to the embodiment, and description of those is omitted.

Figure 9A:
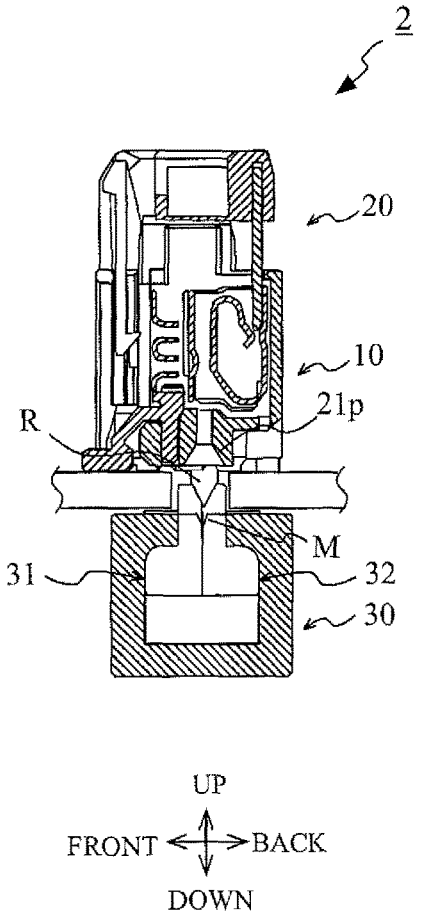
FIG. 9A is a cross sectional view of a connector, which is a modification, in the half-engaged state.
Figure 9B:
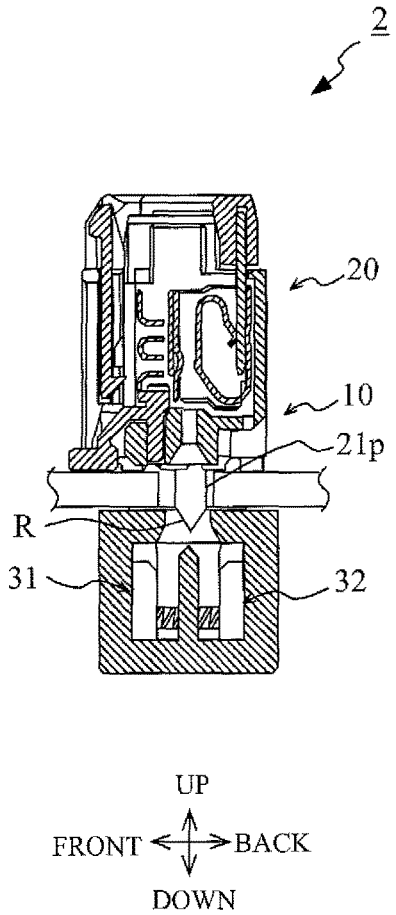
FIG. 9B is a cross sectional view of the connector, which is a modification, in the fully engaged state.

As shown in FIG. 9A and FIG. 9B, the protrusions R are formed at ends of the depress pins 21*p* of the housing 21. At each of the tips of the protrusions R, a taper that gradually tapers toward the lower connector 30 in a direction (front-back direction) in which the first and second movable parts 31 and 32 face each other. In this modification, associated with the depressing of the second connector 20, the tips of the protrusions R formed at ends of the depress pins 21*p* make contact with the gap between the first and second movable parts 31 and 32 on the pin-receiving surfaces 31*h* and 32*h*. This contact continues until the first and second movable parts 31 and 32 slide downward and the engagement between the upper opening of the housing 33 and the upper portions of the first and second movable parts 31 and 32 is released. When the engagement is released, the tips of the protrusions R enter the gap between the first and second movable parts 31 and 32, resulting in transitioning thereof to the second state of being separated from each other after being subjected to the bias force by the urging members 34 (FIG. 9B). As a result, the same function and effect as in the embodiment described above can be obtained.

On the connector 2 shown in FIG. 9A and FIG. 9B, V-shaped groove parts M are formed on the pin-receiving surfaces 31*h* and 32*h* of the first and second movable parts 31 and 32. The V-shaped groove parts M are formed along the gap between the first and second movable parts 31 and 32, and are provided with tapers that gradually expand toward the protrusions R in directions (front-back direction) separating the first and second movable parts 31 and 32 from each other. The V-shaped groove parts M have a slope formed from the pin-receiving surface 31*h* of the first movable part 31 toward the opposing surface, and a slope formed from the pin-receiving surface 32*h* of the second movable part 32 toward the opposing surface. By forming the V-shaped groove parts M in this manner, the tips of the protrusions R can easily enter the gap between the first and second movable parts 31 and 32.

While the invention has been described in detail, the foregoing description is in all aspects illustrative and not restrictive. It will be understood that numerous other modifications and variations can be devised without departing from the scope of the invention.

What is claimed is:

1. A connector assembly comprising an upper connector and a lower connector respectively disposed on top and bottom of a circuit board, the connector configured to connect an external signal terminal inserted from a side of the lower connector to the circuit board via a connection terminal of the upper connector, wherein the lower connector includes:

two movable parts configured to form a guide hole for guiding the external signal terminal to the connection terminal of the upper connector when the two movable parts are moved in proximity while facing each other, a housing having an opening on a side of the upper connector, and configured to house the two movable parts movably from a first state in which the guide hole is formed when an engagement between the opening and two upper portions of the two movable parts is formed to a second state in which the engagement is released and the two movable parts are distanced from the external signal terminal, and an urging member configured to provide a bias force to the two movable parts in directions separating the two movable parts from each other, the upper connector includes a depress part for depressing the two movable parts housed in the housing, the housing includes a protrusion which is disposed at a position enabling the housing to make contact with the two movable parts and is provided with, in a direction in which the two movable parts face each other at a tip of the protrusion, a taper that gradually tapers toward the two movable parts, the protrusion is configured to, after the engagement between the opening of the housing and the upper portions of the two movable parts is released associated with depressing by the depress part, cause the tip of the protrusion to enter a gap through which the two movable parts face each other, and guide the two movable parts in directions separating the two movable parts from each other, the two movable parts includes a groove part which is disposed at a position, in the first state, enabling engagement with the protrusion and which has, in a direction in which the two movable parts face each other and at an end point where a contact is made with the top of the protrusion, and taper gradually expanding toward the protrusion, and the protrusion is configured to, after the engagement between the opening of the housing and the upper portions of the two movable parts is released associated with depressing by the depress part, cause the top of the protrusion to enter, via the groove par, the gap through which the two movable parts face each other, and guide the two movable parts in the directions separating the two movable parts from each other.

* * * * *